US011460027B2

(12) United States Patent
Ullrich et al.

(10) Patent No.: US 11,460,027 B2
(45) Date of Patent: Oct. 4, 2022

(54) METHOD AND APPARATUS FOR PRESSURE EQUALIZATION IN ROTARY COMPRESSORS

(71) Applicant: Lennox Industries Inc., Richardson, TX (US)

(72) Inventors: Brandon Ullrich, Grand Prairie, TX (US); Wei Wang, Dallas, TX (US)

(73) Assignee: Lennox Industries Inc., Richardson, TX (US)

( * ) Notice: Subject to any disclaimer, the term of this patent is extended or adjusted under 35 U.S.C. 154(b) by 253 days.

(21) Appl. No.: 17/016,891

(22) Filed: Sep. 10, 2020

(65) Prior Publication Data

US 2020/0408218 A1 Dec. 31, 2020

Related U.S. Application Data

(63) Continuation of application No. 15/495,061, filed on Apr. 24, 2017, now Pat. No. 10,801,510.

(51) Int. Cl.
*F04C 28/06* (2006.01)
*F04D 27/02* (2006.01)
(Continued)

(52) U.S. Cl.
CPC ..... *F04C 28/06* (2013.01); *F04B 49/06* (2013.01); *F04C 28/24* (2013.01); *F04C 28/28* (2013.01);
(Continued)

(58) Field of Classification Search
CPC ..... F04C 28/06; F04C 28/24; F04C 28/28; F04C 29/0085; F04C 23/008;
(Continued)

(56) References Cited

U.S. PATENT DOCUMENTS 4,286,438 A 9/1981 Clarke
4,820,130 A * 4/1989 Eber ..... F25B 31/026 417/292
(Continued)

FOREIGN PATENT DOCUMENTS

EP 1750348 A2 2/2007
JP S59147959 A 8/1984
JP H09196479 A 7/1997

OTHER PUBLICATIONS

"LR Series Circuit", Electronics Tutorials (Year: 2016).

*Primary Examiner* — Schyler S Sanks
(74) *Attorney, Agent, or Firm* — Shackelford, Bowen, McKinley & Norton, LLP

(57) ABSTRACT

A rotary compressor system includes a compressor housing that includes a compressor motor that draws in fluid from a suction side. The fluid is compressed within a compression chamber and discharged through a discharge side. The compression chamber is disposed between the suction side and the discharge side. An overload-protection switch is electrically coupled in series with the compressor motor and is adapted to cut power to the compressor motor responsive to an overload event. A solenoid valve is fluidly coupled between the compression chamber and a location upstream of the suction side and is electrically coupled in series with the overload-protection switch. An interruption of electrical current to the compressor motor also interrupts electrical current to the solenoid valve, which opens the solenoid valve to equalize pressure between the suction side and the discharge side.

20 Claims, 7 Drawing Sheets

(51) Int. Cl.

| | |
|---|---|
| ***F04C 28/28*** | (2006.01) |
| ***F04C 28/24*** | (2006.01) |
| ***F04C 29/00*** | (2006.01) |
| ***F04D 25/06*** | (2006.01) |
| ***F25B 49/02*** | (2006.01) |
| ***F04B 49/06*** | (2006.01) |
| ***F25B 31/02*** | (2006.01) |
| ***F25B 49/00*** | (2006.01) |
| ***F25B 41/20*** | (2021.01) |
| ***F04C 23/00*** | (2006.01) |

(52) U.S. Cl.
CPC ..... *F04C 29/0085* (2013.01); *F04D 25/06* (2013.01); *F04D 27/0246* (2013.01); *F25B 31/023* (2013.01); *F25B 41/20* (2021.01); *F25B 49/005* (2013.01); *F25B 49/022* (2013.01); *F04C 23/008* (2013.01); *F04C 2240/40* (2013.01); *F04C 2270/07* (2013.01); *F25B 2500/07* (2013.01); *F25B 2500/29* (2013.01); *F25B 2600/0261* (2013.01); *F25B 2600/0271* (2013.01); *F25B 2700/151* (2013.01); *F25B 2700/2115* (2013.01)

(58) Field of Classification Search
CPC .. F04C 2240/40; F04C 2270/07; F04B 49/06; F04D 25/06; F04D 27/0246; F25B 31/023; F25B 41/20; F25B 49/005; F25B 49/022; F25B 2500/07; F25B 2500/29; F25B 2600/0261; F25B 2600/0271; F25B 2700/151; F25B 2700/2115; F24F 1/10
See application file for complete search history.

(56) References Cited

U.S. PATENT DOCUMENTS

| | | | | |
|---|---|---|---|---|
| 5,167,491 | A * | 12/1992 | Keller, Jr. ..... | F04C 28/28 62/196.3 |
| 5,186,613 | A | 2/1993 | Kotlarek et al. | |
| 6,945,073 | B2 | 9/2005 | Matsumoto et al. | |
| 7,086,244 | B2 | 8/2006 | Yamasaki et al. | |
| 7,976,287 | B2 | 7/2011 | Hwang et al. | |
| 9,458,848 | B2 | 10/2016 | Dreiman | |
| 2001/0050541 | A1 * | 12/2001 | Yanashima ..... | H02K 21/46 318/700 |
| 2011/0023535 | A1 | 2/2011 | Morimoto et al. | |
| 2011/0094752 | A1 | 4/2011 | Hudson et al. | |
| 2015/0128629 | A1 | 5/2015 | Kawano et al. | |
| 2016/0148768 | A1 | 5/2016 | Wang | |
| 2018/0180047 | A1 | 6/2018 | Ayub et al. | |
| 2018/0306196 | A1 | 10/2018 | Ullrich et al. | |

* cited by examiner

METHOD AND APPARATUS FOR PRESSURE EQUALIZATION IN ROTARY COMPRESSORS

CROSS-REFERENCE TO RELATED APPLICATION

This application is a continuation of U.S. patent application Ser. No. 15/495,061, filed on Apr. 24, 2017. U.S. patent application Ser. No. 15/495,061 is incorporated herein by reference.

BACKGROUND

Field of the Invention

The present invention relates generally to compressor systems utilized in heating, ventilation, and air conditioning (HVAC) applications and more particularly, but not by way of limitation, to methods and systems for balancing pressure across a rotary compressor or any high-side compressor utilizing a solenoid valve and an internal power circuit.

History of the Related Art

Compressor systems are commonly utilized in HVAC applications. Many HVAC applications utilize high-side compressors that include rotary compressors. High-side compressors, such as rotary compressors, have difficulty starting when a pressure differential between a discharge side and a suction side of the compressor is too high. For example, some compressors may not be able to start when the pressure of the discharge side of the compressor is approximately 7 psi greater than the pressure of the suction side of the compressor.

SUMMARY

In an illustrative embodiment, a rotary compressor system includes a compressor housing that includes a compressor motor that draws in fluid from a suction side. The fluid is compressed within a compression chamber and discharged through a discharge side. The compression chamber is disposed between the suction side and the discharge side. An overload-protection switch is electrically coupled in series with the compressor motor and is adapted to cut power to the compressor motor responsive to an overload event. A solenoid valve is fluidly coupled between the compression chamber and a location upstream of the suction side and is electrically coupled in series with the overload-protection switch. An interruption of electrical current to the compressor motor also interrupts electrical current to the solenoid valve, which opens the solenoid valve to equalize pressure between the suction side and the discharge side.

An illustrative method of equalizing pressure in a rotary-compressor system includes fluidly coupling a solenoid valve between a compression chamber of a compressor housing and a location upstream of a suction side of the compressor housing. The method also includes electrically coupling the solenoid valve in series with an overload-protection switch. Responsive to the overload-protection switch tripping, the solenoid valve is in a closed position to permit equalization of pressure between the suction side of the compressor housing and a discharge side of the compressor housing. Responsive to the overload-protection switch being in a closed position, the solenoid valve is in a closed position to permit a compressed fluid to exit the compressor housing via the discharge side of the compressor housing.

In an illustrative embodiment, a rotary compressor system includes a compressor housing that includes a compressor motor that draws in fluid from a suction side. The fluid is compressed within a compression chamber and discharged through a discharge side. The compression chamber is disposed between the suction side and the discharge side. An overload-protection switch is electrically coupled to the compressor motor and is adapted to cut power to the compressor motor responsive to an overload event. A solenoid valve is fluidly coupled between the compression chamber and a location upstream of the suction side and is adapted to be electrically coupled to a power source. A current detector is electrically coupled in series between the power source and a combination of the solenoid valve and the overload-protection switch. The current detector cuts power to the solenoid valve in response to the compressor motor losing power to open the solenoid valve so that pressure between the suction side and the discharge side can equalize.

An illustrative method of equalizing pressure in a rotary-compressor system includes fluidly coupling a solenoid valve between a compression chamber of a compressor housing and a suction side of the compressor housing. The method also includes electrically, coupling the solenoid valve in parallel with a compressor motor and electrically coupling a current detector in series with a combination of the solenoid valve and the compressor motor so that the current detector measures a current drawn by the solenoid valve and the compressor motor. The method further includes electrically coupling a switch to the solenoid valve such that when the switch is open the solenoid valve is depowered to open the solenoid valve. Responsive to the current detector detecting a first current level indicating that the compressor motor is operating, the current detector sends a signal to the switch to close the switch. Responsive to the current detector detecting a second current level indicating that the compressor motor is not operating, the current detector sends a signal to the switch to open the switch.

BRIEF DESCRIPTION OF THE DRAWINGS

For a more complete understanding of the present invention and for further objects and advantages thereof, reference may now be had to the following description taken in conjunction with the accompanying drawings, in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
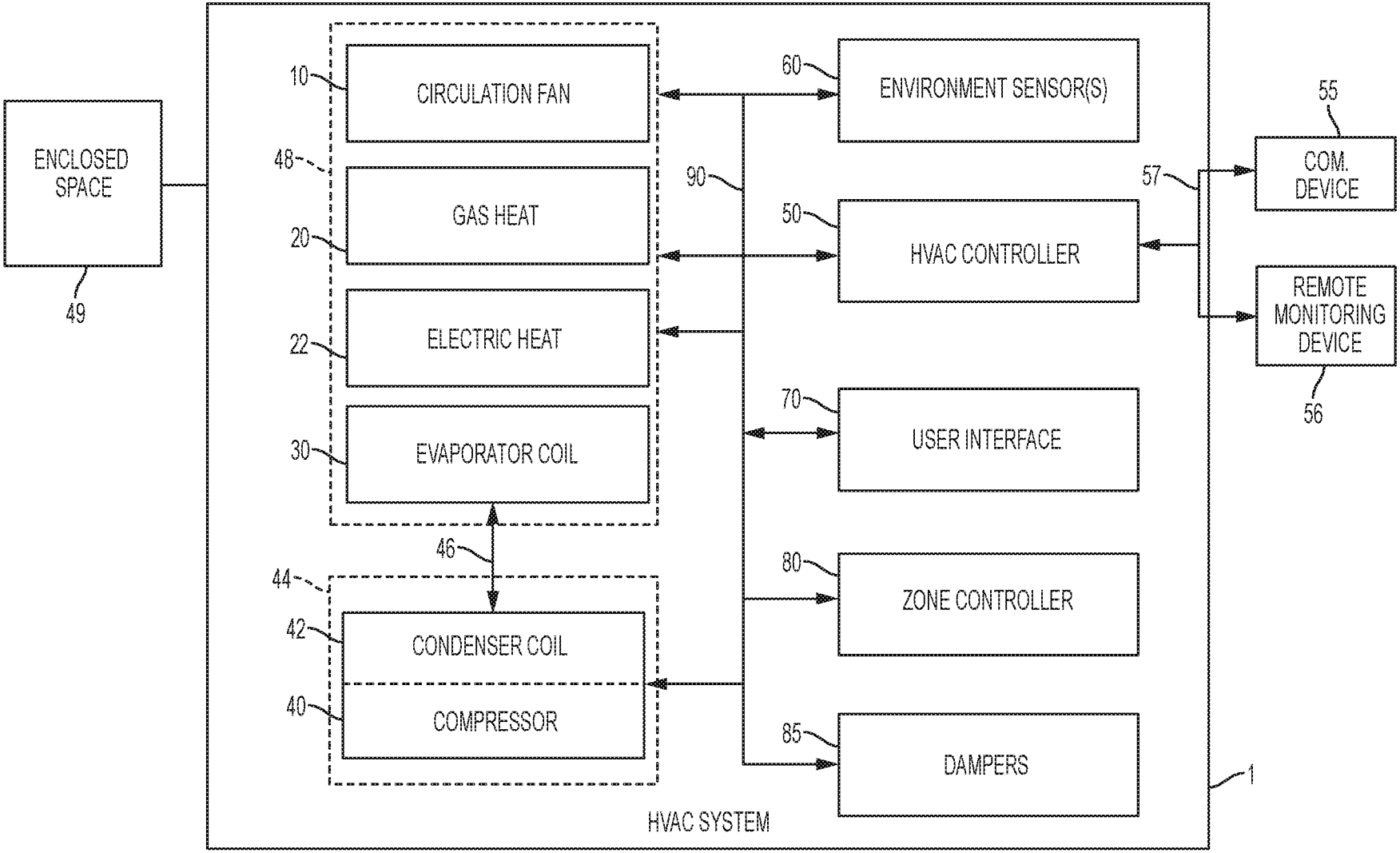
FIG. 1 is a block diagram of an illustrative HVAC system.

FIG. 1 is a block diagram illustrating an HVAC system 1. In a typical embodiment, the HVAC system 1 is a networked HVAC system that is configured to condition air via, for example, heating, cooling, humidifying, or dehumidifying air. The HVAC system 1 can be a residential system or a commercial system such as, for example, a roof top system. For exemplary illustration, the HVAC system 1 as illustrated in FIG. 1 includes various components; however, in other embodiments, the HVAC system 1 may include additional components that are not illustrated but typically included within HVAC systems.

The HVAC system 1 includes a variable-speed circulation fan 10, a gas heat 20, electric heat 22 typically associated with the variable-speed circulation fan 10, and a refrigerant evaporator coil 30, also typically associated with the variable-speed circulation fan 10. The variable-speed circulation fan 10, the gas heat 20, the electric heat 22, and the refrigerant evaporator coil 30 are collectively referred to as an "indoor unit" 48. In a typical embodiment, the indoor unit 48 is located within, or in close proximity to, an enclosed space 49. The HVAC system 1 also includes a variable-speed compressor 40 and a condenser coil 42, which are typically referred to as an "outdoor unit" 44. In various embodiments, the outdoor unit 44 is, for example, a rooftop unit or a ground-level unit. The variable-speed compressor 40 and the condenser coil 42 are connected to the refrigerant evaporator coil 30 by a refrigerant line 46. In a typical embodiment, the variable-speed compressor 40 is, for example, a single-stage compressor, a multi-stage compressor, a single-speed compressor, or a variable-speed compressor. Also, as will be discussed in more detail below, in various embodiments, the variable-speed compressor 40 may be a compressor system including at least two compressors of the same or different capacities. The variable-speed circulation fan 10, sometimes referred to as a blower, is configured to operate at different capacities (i.e., variable motor speeds) to circulate air through the HVAC system 1, whereby the circulated air is conditioned and supplied to the enclosed space 49.

Still referring to FIG. 1, the HVAC system 1 includes an HVAC controller 50 that is configured to control operation of the various components of the HVAC system 1 such as, for example, the variable-speed circulation fan 10, the gas heat 20, the electric heat 22, and the variable-speed compressor 40. In some embodiments, the HVAC system 1 can be a zoned system. In such embodiments, the HVAC system 1 includes a zone controller 80, dampers 85, and a plurality of environment sensors 60. In a typical embodiment, the HVAC controller 50 cooperates with the zone controller 80 and the dampers 85 to regulate the environment of the enclosed space 49.

The HVAC controller 50 may be an integrated controller or a distributed controller that directs operation of the HVAC system 1. In a typical embodiment, the HVAC controller 50 includes an interface to receive, for example, thermostat calls, temperature setpoints, blower control signals, environmental conditions, and operating mode status for various zones of the HVAC system 1. In a typical embodiment, the HVAC controller 50 also includes a processor and a memory to direct operation of the HVAC system 1 including, for example, a speed of the variable-speed circulation fan 10.

Still referring to FIG. 1, in some embodiments, the plurality of environment sensors 60 is associated with the HVAC controller 50 and also optionally associated with a user interface 70. In some embodiments, the user interface 70 provides additional functions such as, for example, operational, diagnostic, status message display, and a visual interface that allows at least one of an installer, a user, a support entity, and a service provider to perform actions with respect to the HVAC system 1. In some embodiments, the user interface 70 is, for example, a thermostat of the HVAC system 1. In other embodiments, the user interface 70 is associated with at least one sensor of the plurality of environment sensors 60 to determine the environmental condition information and communicate that information to the user. The user interface 70 may also include a display, buttons, a microphone, a speaker, or other components to communicate with the user. Additionally, the user interface 70 may include a processor and memory that is configured to receive user-determined parameters, and calculate operational parameters of the HVAC system 1 as disclosed herein.

In a typical embodiment, the HVAC system 1 is configured to communicate with a plurality of devices such as, for example, a remote monitoring device 56, a communication device 55, and the like. In a typical embodiment, the remote monitoring device 56 is not part of the HVAC system. For example, the remote monitoring device 56 is a server or computer of a third party such as, for example, a manufacturer, a support entity, a service provider, and the like. In other embodiments, the remote monitoring device 56 is located at an office of, for example, the manufacturer, the support entity, the service provider, and the like.

In a typical embodiment, the communication device 55 is a non-HVAC device having a primary function that is not associated with HVAC systems. For example, non-HVAC devices include mobile-computing devices that are configured to interact with the HVAC system 1 to monitor and modify at least some of the operating parameters of the HVAC system 1. Mobile computing devices may be, for example, a personal computer (e.g., desktop or laptop), a tablet computer, a mobile device (e.g., smart phone), and the like. In a typical embodiment, the communication device 55 includes at least one processor, memory and a user interface, such as a display. One skilled in the art will also understand that the communication device 55 disclosed herein includes other components that are typically included in such devices including, for example, a power source, a communications interface, and the like.

The zone controller 80 is configured to manage movement of conditioned air to designated zones of the enclosed space 49. Each of the designated zones include at least one conditioning or demand unit such as, for example, the gas heat 20 and at least one user interface 70 such as, for example, the thermostat. The HVAC system 1 allows the user to independently control the temperature in the designated zones. In a typical embodiment, the zone controller 80 operates the dampers 85 to control air flow to the zones of the enclosed space 49.

In some embodiments, a data bus 90, which in the illustrated embodiment is a serial bus, couples various components of the HVAC system 1 together such that data is communicated therebetween. In a typical embodiment, the data bus 90 may include, for example, any combination of hardware, software embedded in a computer readable medium, or encoded logic incorporated in hardware or otherwise stored (e.g., firmware) to couple components of the HVAC system 1 to each other. As an example and not by way of limitation, the data bus 90 may include an Accelerated Graphics Port (AGP) or other graphics bus, a Controller Area. Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus 90 may include any number, type, or configuration of data buses 90, where appropriate. In particular embodiments, one or more data buses 90 (which may each include an address bus and a data bus) may couple the HVAC controller 50 to other components of the HVAC system 1. In other embodiments, connections between various components of the HVAC system 1 are wired. For example, conventional cable and contacts may be used to couple the HVAC controller 50 to the various components. In some embodiments, a wireless connection is employed to provide at least some of the connections between components of the HVAC system such as, for example, a connection between the HVAC controller 50 and the variable-speed circulation fan 10 or the plurality of environment sensors 60.

Figure 2A:
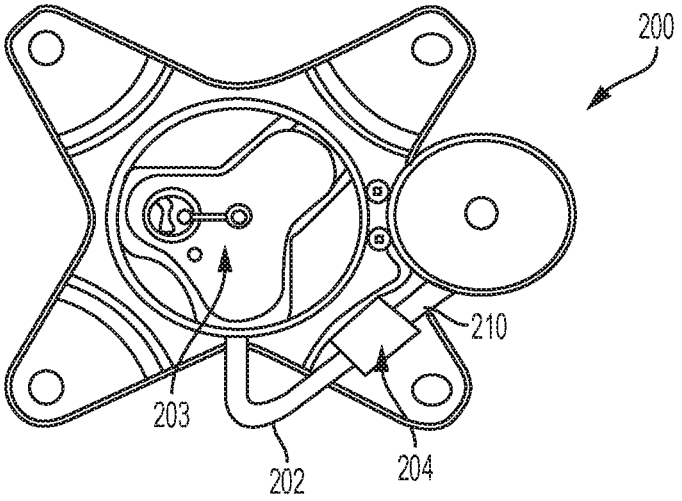
FIG. 2A PRIOR ART
FIG. 2A is a schematic diagram of a top of a prior art rotary compressor system.
Figure 2B:
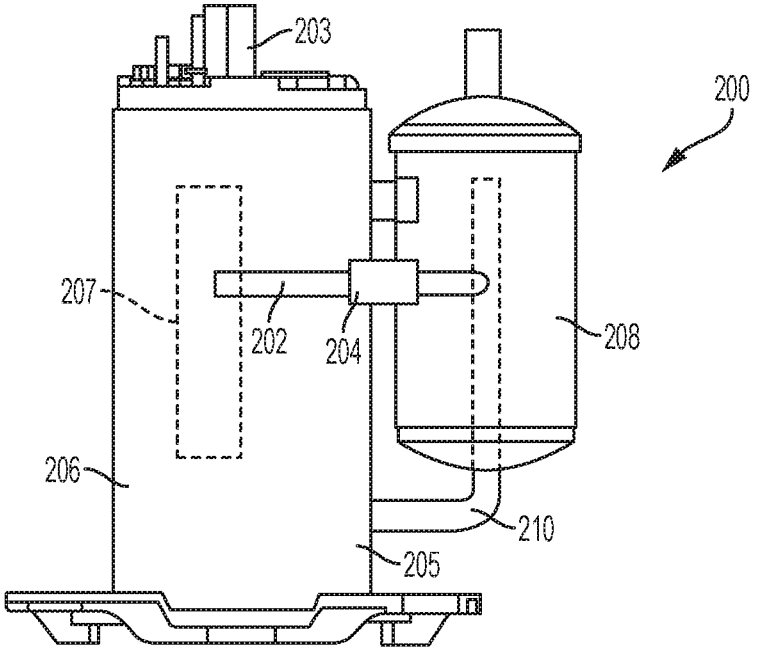
FIG. 2B PRIOR ART
FIG. 2B is a schematic diagram of a side of the prior art rotary compressor system of FIG. 2A.

FIG. 2A illustrates a top view of a prior art rotary compressor system 200 and FIG. 2B is a side view of the prior art rotary compressor system 200. For purposes of illustration, FIGS. 2A and 2B will be discussed herein relative to FIG. 1. The rotary compressor system 200 includes a pressure-equalization tube 202 and a solenoid valve 204 that are in fluid communication with a compressor housing 206. An accumulator 208 is fluidly coupled to a suction side 205 of the compressor housing 206 via a suction tube 210. The pressure-equalization tube 202 fluidly couples the accumulator 208 to a compression chamber 207 within the compressor housing 206. The compression chamber 207 is a portion within the compressor housing 206 between a discharge side 203 and the suction side 205 of the compressor housing 206. In other embodiments, the pressure-equalization tube 202 may be coupled between the compression chamber 207 and a location upstream of the suction side 205.

As shown in FIG. 2B, the suction tube 210 couples to the accumulator 208 at a level approximately equal to or above a level where the pressure-equalization tube 202 couples to the accumulator 208. The solenoid valve 204 is disposed so as to open and close access to the pressure-equalization tube 202. In a typical embodiment, the solenoid valve 204 is a solenoid valve. In other embodiments, other types of remote-actuated valves could be utilized in accordance with design requirements.

Figure 3:
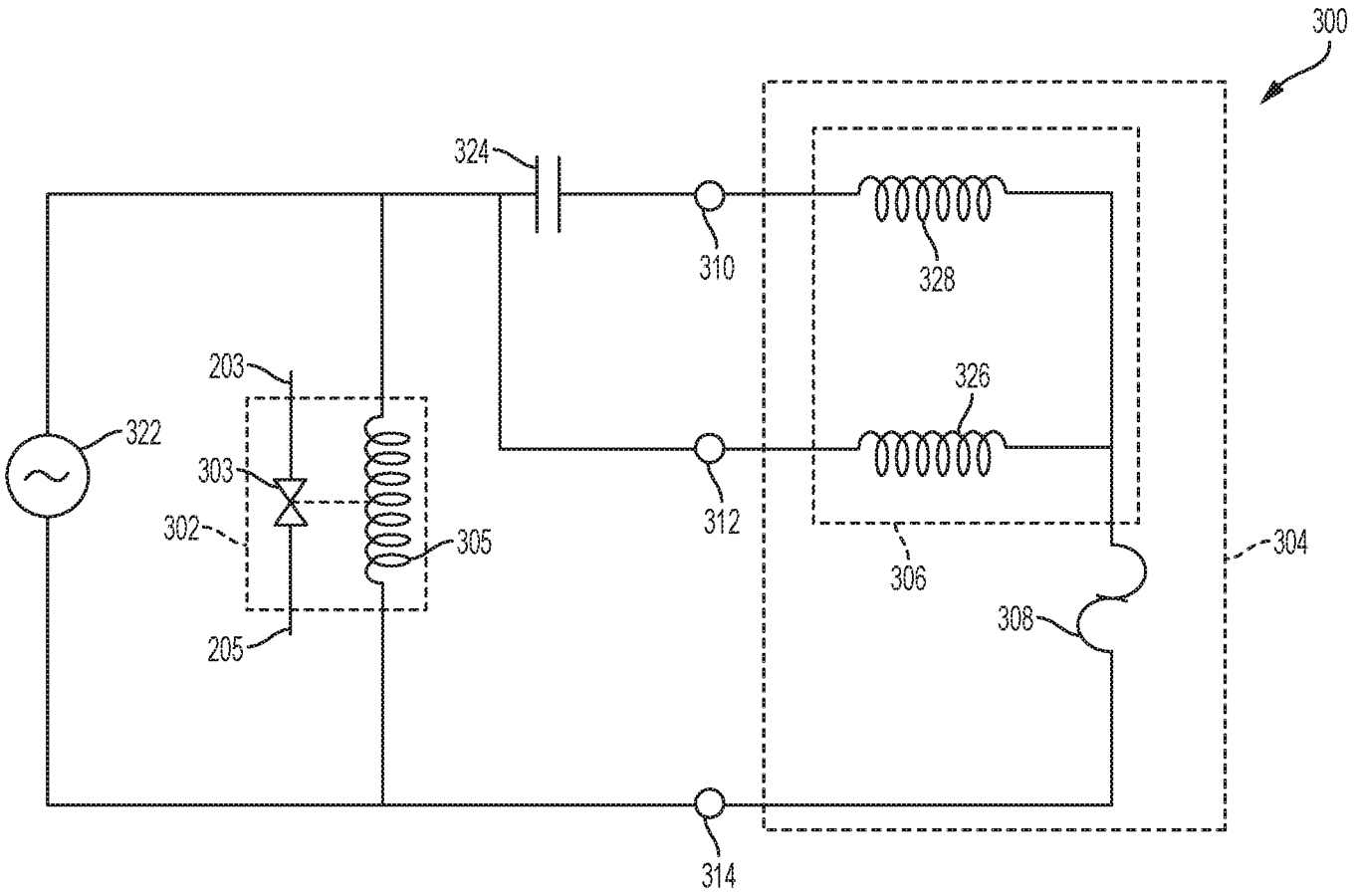
FIG. 3 PRIOR ART
FIG. 3 is a circuit diagram of an illustrative prior art rotary compressor system.

FIG. 3 is a circuit diagram illustrating a prior art rotary compressor system 300. For purposes of illustration, FIG. 3 will be discussed herein relative to FIGS. 1 and 2A-2B. The rotary compressor system 300 includes a solenoid valve 302 and a compressor housing 304. The compressor housing 304 houses a compressor motor 306 and an overload-protection switch 308. In some embodiments, the compressor housing 304 is similar to the compressor housing 206. The compressor motor 306 includes a main winding 326 and an auxiliary winding 328, each of which are connected to a power source 322. As will be understood by those having skill in the art, when the main winding 326 and the auxiliary winding 328 are provided with an electric current, the main winding 326 and the auxiliary winding impart rotation upon a roller within the compressor housing 304. The rotation of the roller within the compressor housing 304 compresses a refrigerant within the compression chamber 207.

The rotary compressor system 300 includes a first terminal 310, a second terminal 312, and a third terminal 314 that are adapted to connect the power source 322 to components within the compressor housing 304. As shown in FIG. 3, the first terminal 310 is connected to a first electrical lead 316, the second terminal 312 is connected to a second electrical lead 318, and the third terminal 314 is connected to a third electrical lead 320. The first electrical lead 316 connects the auxiliary winding 328 to the power source 322 through a capacitor 324. The second electrical lead 318 connects the main winding 326 to the power source 322. The third electrical lead 320 connects the overload-protection switch 308 to the power source 322. As will be understood by those having skill in the art, the capacitor 324 is used to shift a phase of the voltage from the power source 322 in order to provide the compressor motor 306 with two voltage phases, which is necessary to enable the compressor motor 306 to operate.

The overload-protection switch 308 is disposed within the compressor housing 304 and is configured to interrupt electrical current between the compressor motor 306 and the power source 322 responsive to an overload event. An overload event is a result of the compressor motor 306 drawing too much electrical current. As the current drawn by the compressor motor 306 increases, additional heat is generated. The additional heat can cause the temperature within the compressor housing 304 to increase. As the temperature within the compressor housing 304 increases, the temperature within the compressor housing 304 may reach a value that trips the overload-protection switch 308. The overload-protection switch 308 opens at a temperature that prevents damage to the compressor motor 306 and other components within the compressor housing 304. In a typical embodiment, the overload-protection switch 308 is a bimetallic switch that is sensitive to heat generated inside the compressor housing 304. In other embodiments, other types of current-interrupt devices can be utilized as dictated by design requirements. As will be appreciated by those having skill in the art, the overload-protection switch 308 may be designed to trip at other temperatures in keeping with design requirements.

Overload events can occur for various reasons. For example, overload events can occur more easily when the condenser coil 42 is dirty or when ambient temperatures are high. A dirty condenser coil 42 reduces an ability of the rotary compressor system 300 to reject heat from a compressed refrigerant passing through the condenser coil 42, which reduced ability causes the compressor motor 306 to draw additional current. The additional current can cause the compressor motor 306 to generate more heat and result in an overload event that causes the overload-protection switch 308 to trip. Similarly, high ambient temperatures can also reduce an ability of the rotary compressor system 300 to reject heat from the compressed refrigerant because higher ambient temperatures reduce a temperature differential between ambient air and the compressed refrigerant passing through the condenser coil 42. The reduction in temperature differential reduces an efficiency of heat transfer between the compressed refrigerant in the condenser coil 42 and the ambient air. In either case, the compressor motor 306 tends to draw additional current, which can result in increased electrical load across the compressor motor 306. If the load becomes high enough, the temperature of the overload-protection switch 308 will increase and eventually trip open in order to prevent damage to the compressor motor 306.

During operation of the rotary compressor system 300, electrical current is supplied to the solenoid valve 302. As shown, the solenoid valve 302 includes a valve 303 that is coupled to drive coil 305. The drive coil 305 operates the valve 30:3 to switch the valve 303 between open and closed positions. When electrical current is supplied to the drive coil 305, the valve 303 is in a closed position to prevent flow of refrigerant therethrough. If the overload-protection switch 308 interrupts electrical current to the compressor motor 306, electrical current is not interrupted to the drive coil 305 because, as shown in FIG. 3, the overload-protection switch 308 is connected to power source 322 in parallel with the drive coil 305. Because power to the drive coil 305 is not interrupted, the valve 303 remains closed and a pressure differential between the discharge side 203 and the suction side 205 is not allowed to quickly equalize. As a result of the unequalized pressure, the compressor motor 306 may not be able to restart until the pressure differential between the discharge side 203 and the suction side 205 has equalized or at least has reduced so that the pressure of the discharge side 203 is within approximately 7 psi of the suction side 205. It is noted that even with the valve 302 closed, the pressure differential between the discharge side 203 and the suction side 205 will eventually equalize as the pressure slowly bleeds from the discharge side 203. However, equalization of the pressure with the valve 303 closed may take between approximately 30 minutes to an hour. If the overload-protection switch 308 cools enough to close before the pressure differential between the discharge side 203 and the suction side 205 has sufficiently decreased (e.g., within approximately 7 psi of one another), the compressor motor 306 may fail to start because of the pressure differential between the discharge side 203 and the suction side 205 is too great.

Figure 4:
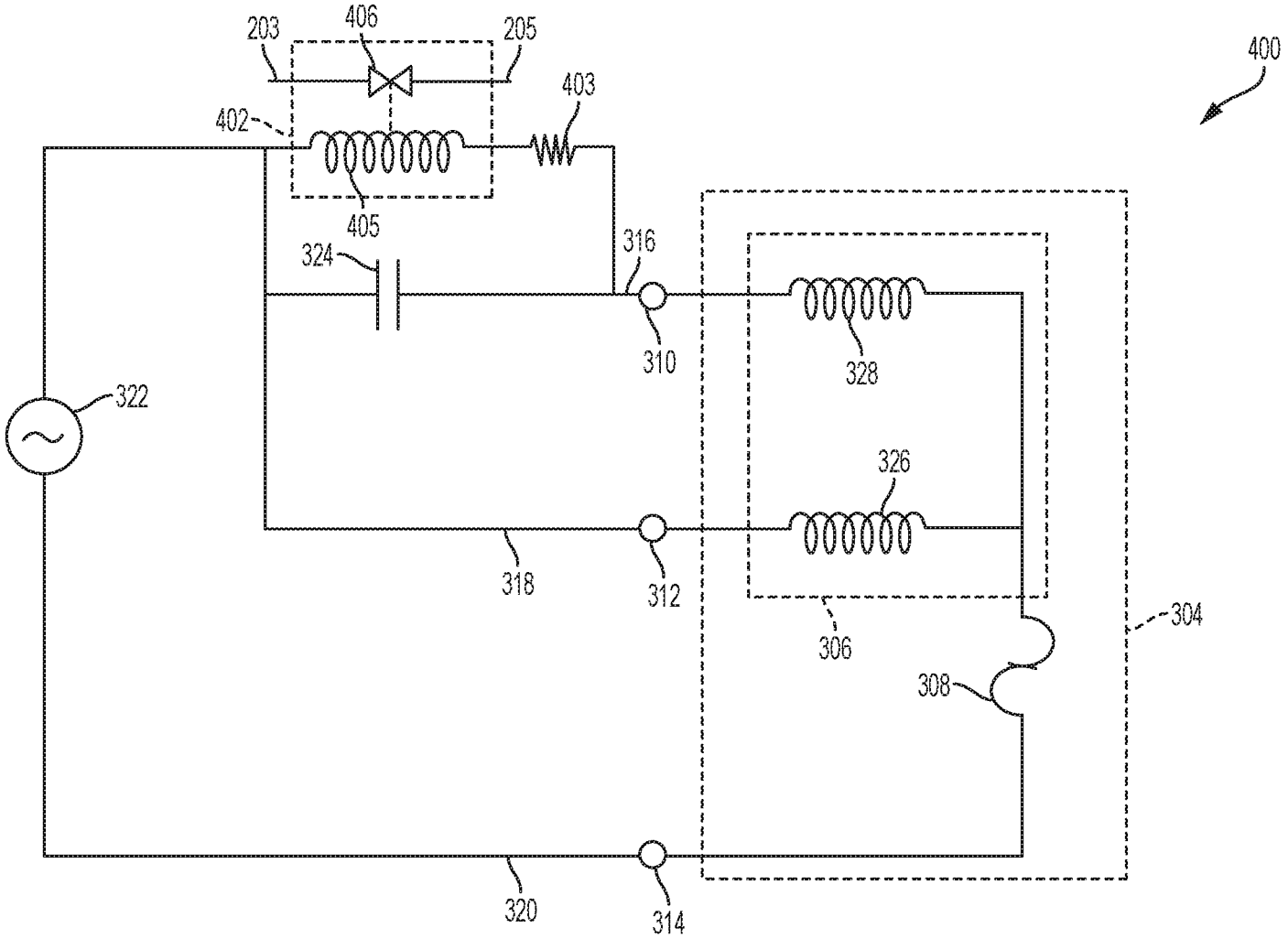
FIG. 4 is a circuit diagram of an illustrative rotary compressor system.

FIG. 4 is a circuit diagram of a rotary compressor system 400 according to an exemplary embodiment. For purposes of illustration, FIG. 4 will be discussed herein relative to FIGS. 1, 2A, 2B, and 3. The rotary compressor system 400 is similar to the rotary, compressor system 300, but a solenoid valve 402 has been wired in series with the overload-protection switch 308 and the power source 322. The solenoid valve 402 includes a valve 406 that is coupled to a drive coil 405. The drive coil 405 operates the valve 406 to switch the valve 406 between open and closed positions. Wiring the solenoid valve 402 in series with the overload-protection switch 308 ensures that electrical current to the drive coil 405 is interrupted when the overload-protection switch 308 trips. Thus, when the compressor motor 306 stops operating as a result of the overload-protection switch 308 tripping, the valve 406 opens to allow any pressure differential between the discharge side 203 and the suction side 205 to equalize.

As shown in FIG. 4, the rotary compressor system 400 includes the compressor housing 304 that houses the compressor motor 306 and the overload-protection switch 308. The compressor motor 306 comprises the main winding 326 and the auxiliary winding 328, each of which are connected to the power source 322. The overload-protection switch 308 is disposed within the compressor housing 304 and is configured to interrupt electrical current between the compressor motor 306 and the power source 322.

As shown in FIG. 4, the solenoid valve 402 is arranged in parallel with the capacitor 324. As will be understood by those having skill in the art, the drive coil 405 of the solenoid valve 402 is selected so that the voltage drop across the drive coil 405 is the same as the voltage drop across the capacitor 324. Matching the voltage drop across the drive coil 405 with the voltage drop across the capacitor 324 ensures that the phases of the voltage supplied to the main winding 326 and the auxiliary winding 328 are not altered compared to the rotary compressor system 300. In some embodiments, tuning of the voltage drop across the drive coil 405 may be accomplished by wiring one or more resistors 403 as shown in FIG. 4.

In a typical embodiment, when electrical current is supplied to the solenoid valve 402, the solenoid valve 402 closes and prevents flow of refrigerant through the solenoid valve 402. When the overload-protection switch 308 trips, electrical current to the compressor motor 306 and the solenoid valve 402 is interrupted. Electrical current to the solenoid valve 402 is interrupted because the solenoid valve 402 is connected in series with the overload-protection switch 308. Interruption of electrical current to the solenoid valve 402 causes the solenoid valve 402 to open, thereby allowing compressed refrigerant to exit the discharge side 203 to equalize pressure between the discharge side 203 and the suction side 205. For example, when an overload event occurs, the overload-protection switch 308 trips and interrupts electrical current to the compressor motor 306. Because the solenoid valve 402 is connected in series between the power source 322 and the overload-protection switch 308, electrical current to the solenoid valve 402 is interrupted and the solenoid valve 402 opens. With the solenoid valve 402 open, any compressed refrigerant that would otherwise be trapped within the compression chamber 207 of the compressor housing 304 is permitted to flow out of the compression chamber 207 through the solenoid valve 402, thus equalizing pressure between the suction side 205 and the discharge side 203. After the temperature within the compressor housing 304 has fallen enough for the overload-protection switch 308 to close, the compressor motor 306 may resume operation because the compressor motor 306 is not prevented from restarting due to a pressure differential between the discharge side 203 and the suction side 205.

Figure 5:
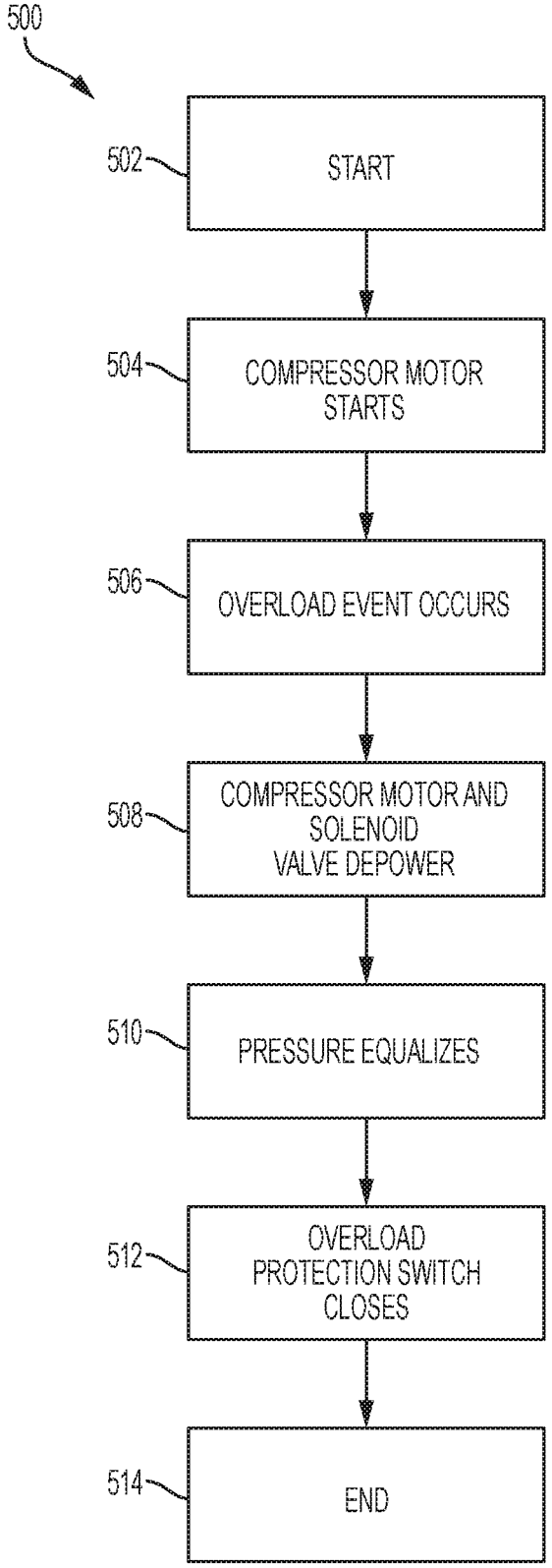
FIG. 5 is a flow diagram illustrating a process for balancing pressure across a rotary compressor.

FIG. 5 is a flow diagram illustrating a process 500 for balancing pressure in a rotary compressor system. For purposes of illustration, FIG. 5 will be discussed herein relative to FIGS. 2A, 2B, and 4. The process 500 starts at step 502. At step 504, the compressor motor 306 begins operation and compresses a refrigerant. At step 506, an overload event occurs that causes the overload-protection switch 308 to trip. At step 508, the compressor motor 306 and the solenoid valve 402 are depowered as a result of the tripping of the overload-protection switch 308. At step 510, a pressure differential between the discharge side 203 and the suction side 205 is allowed to equalize because the solenoid valve 402 is open. At step 512, the compressor housing 304 has cooled and the overload-protection switch 308 closes. Once the overload-protection switch 308 has closed, the compressor motor 306 and the solenoid valve 402 are reconnected to the power source 322 and can resume normal operation. After step 512, the process 500 proceeds to step 514 where the process 500 ends.

Figure 6:
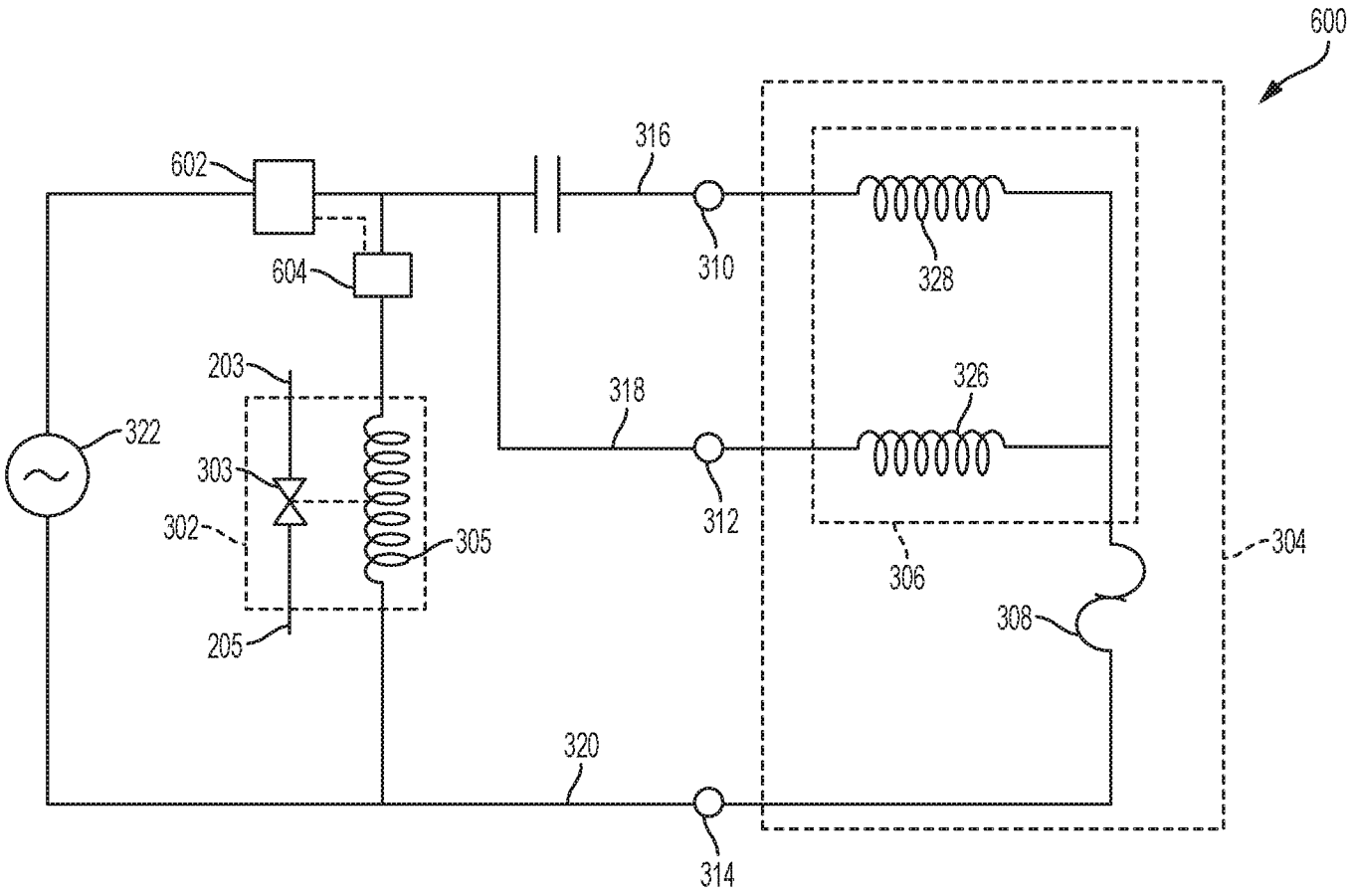
FIG. 6 is a circuit diagram of an illustrative rotary compressor system.

FIG. 6 is a circuit diagram of a rotary compressor system 600. For purposes of illustration, FIG. 6 will be discussed herein relative to FIGS. 1, 2A, 2B, 3, and 4. The rotary compressor system 600 is similar to the rotary compressor system 300, but includes a current detector 602 and a switch 604. As shown in FIG. 6, the current detector 602 is wired in series with the power source 322 and a combination of the solenoid valve 302 and the compressor motor 306. In a typical embodiment, the current detector 602 comprises a current-sensing relay, such as, for example, a Function Devices, Inc. RIBXKF relay.

During operation of the rotary compressor system 600, the compressor motor 306 draws a proportionally larger amount of electrical current compared to the drive coil 305. For example, the compressor motor 306 may draw an electrical current on the order of several amps and the drive coil 305 may draw an electrical current on the order of several milliamps. The current detector 602 is configured to detect a first current level and a second current level. The first current level is a sum of the current drawn by the compressor motor 306 and the current drawn by the drive coil 305 and the second current level includes only the current drawn by the drive coil 305.

When an overload event occurs and the overload-protection switch 308 is tripped, the compressor motor 306 shuts off as the circuit between the power source 322 and the compressor motor 306 is broken by the tripping of the overload-protection switch 308. However, because the drive coil 305 is wired in parallel with the compressor motor 306 and the overload-protection switch 308, the drive coil 305 continues to receive power from the power source 322. When the overload-protection switch 308 trips, the current detector 602 detects a large drop in current between the first current level and the second current level. In response to detecting the second current level, the current detector 602 sends a signal to the switch 604 to interrupt the electrical current to the solenoid valve 302. When the drive coil 305 is depowered, the valve 303 opens and a pressure differential between the discharge side 203 and the suction side 205 is allowed to equalize. After the overload-protection switch 308 has sufficiently cooled, the overload-protection switch 308 closes and the compressor motor 306 powers back on. The amount of time necessary for the overload-protection switch 308 to close depends on various environmental conditions such as, for example, ambient temperature. Once the compressor motor 306 has powered back on, the current detector 602 detects the first current level and sends a signal to the switch 604 to close the solenoid valve 302 so that the rotary compressor system 600 may continue normal operation.

Figure 7:
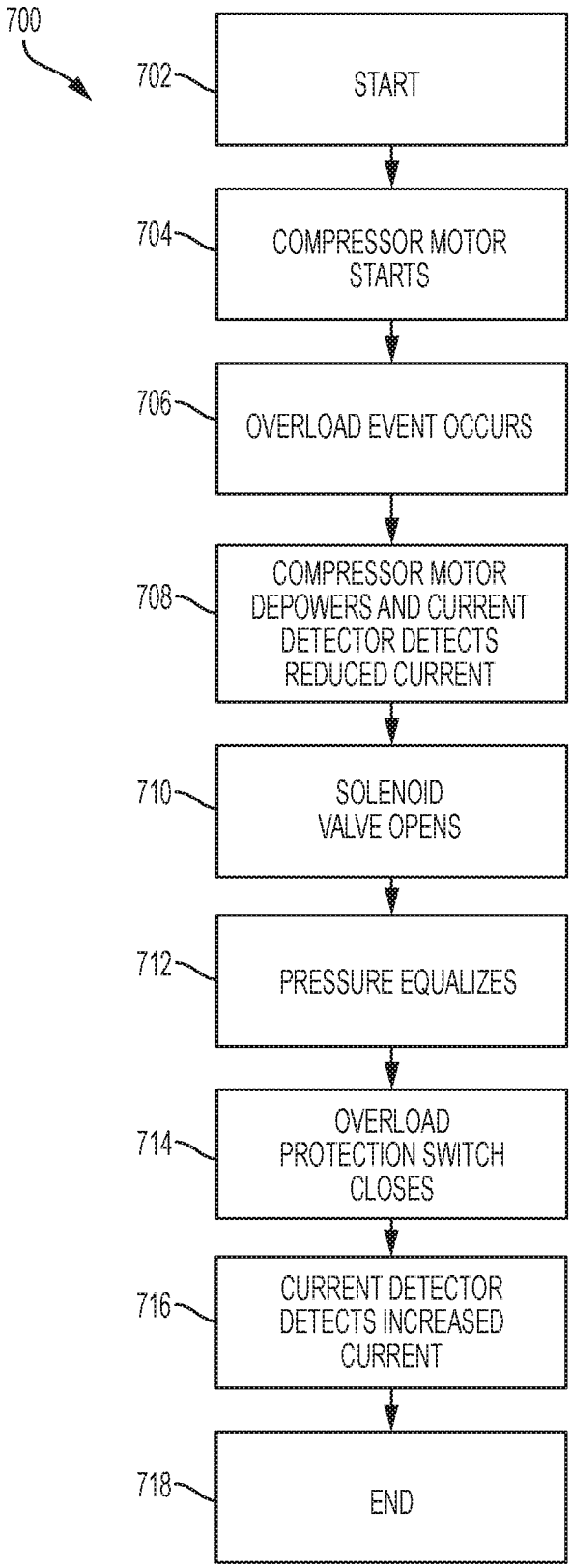
FIG. 7 is a flow diagram illustrating a process for balancing pressure across a rotary compressor.

FIG. 7 is a flow diagram illustrating a process 700 for balancing pressure in a rotary compressor system. For purposes of illustration, FIG. 6 will be discussed herein relative to FIGS. 2A, 2B, and 5. The process 700 starts at step 702. At step 704, the compressor motor 306 begins operation to compress a refrigerant and the current detector 602 detects a first current level that indicates that the compressor motor 306 and the pressure-drive coil 305 are both being powered. At step 706, an overload event occurs that causes the overload-protection switch 308 to trip. At step 708, the compressor motor 306 is depowered as a result of the tripping of the overload-protection switch 308 and the current detector 602 detects a second current level that is less than the first current level, indicating that the compressor motor 306 is not operating. Responsive to the detection of the second current level, the overload-protection switch 308 sends a signal to the switch 604 to depower the drive coil 305 to open the valve 303. At step 712, a pressure differential between the discharge side 203 and the suction side 205 is allowed to equalize because the valve 303 is open. At step 714, the compressor housing 304 has sufficiently cooled so that the overload-protection switch 308 closes. Once the overload-protection switch 308 has closed, the compressor motor 306 is reconnected to the power source 322 and resumes operation. At step 716, the current detector 602 detects the first current level that results from the increase in electrical current drawn by the compressor motor 306 resuming operation and sends a signal to the switch 604 to close the valve 303. After step 716, the process 700 ends.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A rotary compressor system comprising:

a compressor housing comprising:

a compressor motor;

a suction side;

a discharge side; a compression chamber; and an overload-protection switch electrically coupled to the compressor motor and adapted to cut power to the compressor motor responsive to an overload event;

a solenoid valve comprising a valve fluidly coupled between the compression chamber and a location upstream of the suction side and a drive coil adapted to be electrically coupled to a power source;

a current detector electrically coupled in series between the power source and a combination of the drive coil and the overload-protection switch; and wherein the current detector cuts power to the drive coil in response to the compressor motor losing power to open the valve so that pressure between the suction side and the discharge side can equalize.

2. The rotary compressor system of claim 1, further comprising:

a switch electrically coupled in series with the drive coil; and wherein the current detector controls operation of the switch to facilitate pressure equalization of the compressor housing.

3. The rotary compressor system of claim 1, further comprising:

an accumulator coupled to the suction side; and wherein the valve is fluidly coupled to the accumulator via a pressure-equalization tube.

4. The rotary compressor system of claim 1, further comprising:

an outdoor unit comprising:

the compressor housing; and a condenser coil fluidly coupled to the discharge side of the compressor housing.

5. The rotary compressor system of claim 1, further comprising:

an indoor unit comprising:

an evaporator coil fluidly coupled to the condenser coil; and a circulation fan adapted to blow air from an enclosed space over the evaporator coil.

6. A method of equalizing pressure in a rotary compressor system, the method comprising:

fluidly coupling a valve of a solenoid valve between a compression chamber of a compressor housing and a suction side of the compressor housing; and electrically coupling a drive coil of the solenoid valve in parallel with a compressor motor;

electrically coupling a current detector in series with a combination of the drive coil and the compressor motor so that the current detector measures a current drawn by the drive coil and the compressor motor;

electrically coupling a switch to the drive coil such that when the switch is open the drive coil is depowered to open the valve;

wherein, responsive to the current detector detecting a first current level indicating that the compressor motor is operating, the current detector sends a signal to the switch to close the switch; and wherein, responsive to the current detector detecting a second current level indicating that the compressor motor is not operating, the current detector sends a signal to the switch to open the switch.

7. The method of claim 6, wherein the compressor stops operating responsive to an overload-protection switch tripping.

8. The method of claim 6, wherein, responsive to the valve opening, fluid flows from a compression chamber within the compressor housing to a location upstream of the suction side.

9. The method of claim 6, wherein the current detector controls operation of the switch to facilitate pressure equalization of the compressor housing.

10. The method of claim 6, wherein the rotary compressor system comprises:

an outdoor unit comprising:

the compressor housing; and a condenser coil fluidly coupled to the discharge side of the compressor housing.

11. The method of claim 6, wherein the rotary compressor system comprises:

an indoor unit comprising:

an evaporator coil fluidly coupled to the condenser coil; and a circulation fan adapted to blow air from an enclosed space over the evaporator coil.

12. A rotary compressor system comprising:

a compressor housing comprising:

a compressor motor;

a suction side;

a discharge side; a compression chamber; and an overload-protection switch electrically coupled in series with the compressor motor and adapted to cut power to the compressor motor responsive to an overload event;

a solenoid valve comprising a valve fluidly coupled between the compression chamber and a location upstream of the suction side and a drive coil adapted to be electrically coupled to a power source;

a current detector electrically coupled in series between the power source and a combination of the drive coil and the overload-protection switch;

a switch electrically coupled in series with the drive coil; and wherein the current detector cuts power to the drive coil in response to the compressor motor losing power to open the valve so that pressure between the suction side and the discharge side can equalize.

13. The rotary compressor system of claim 12, wherein the current detector controls operation of the switch to facilitate pressure equalization of the compressor housing.

14. The rotary compressor system of claim 12, further comprising:

an accumulator coupled to the suction side; and wherein the valve is fluidly coupled to the accumulator via a pressure-equalization tube.

15. The rotary compressor system of claim 12, further comprising:

an outdoor unit comprising:

the compressor housing; and a condenser coil fluidly coupled to the discharge side of the compressor housing.

16. The rotary compressor system of claim 12, further comprising:

an indoor unit comprising:

an evaporator coil fluidly coupled to the condenser coil; and a circulation fan adapted to blow air from an enclosed space over the evaporator coil.

17. The rotary compressor system of claim 12, wherein the drive coil is coupled in parallel with the compressor motor and the overload-protection switch.

18. The rotary compressor system of claim 12, wherein the current detector comprises a current-sensing relay.

19. The rotary compressor system of claim 12, wherein the current detector is configured to detect a first current level and a second current level.

20. The rotary compressor system of claim 19, wherein:

the first current level is a sum of a current drawn by the compressor motor and the drive coil; and the second current level comprises only the current drawn by the drive coil.

* * * * *